United States Patent [19]

Dahmen

[11] 4,064,916

[45] Dec. 27, 1977

[54] ARRANGEMENT FOR INTERMITTENT FEEDING OF CABLE COILS ARRESTING ON A DISTRIBUTION CONVEYOR

[75] Inventor: Hans Peter Dahmen, Wipperfurth, Germany

[73] Assignee: Bergmann Kabelwerke AG, Wipperfurth, Germany

[21] Appl. No.: 578,784

[22] Filed: May 19, 1975

[30] Foreign Application Priority Data

May 18, 1974 Germany ..... 2424281

[51] Int. Cl.[2] ..... B21F 23/00

[52] U.S. Cl. ..... 140/2; 83/236; 83/907

[58] Field of Search ..... 72/66, 132, 137; 140/1, 140/2, 102; 226/119, 124; 242/79, 82; 83/236, 907

[56] References Cited

FOREIGN PATENT DOCUMENTS 2,010,428 2/1970 France ..... 72/66

*Primary Examiner*—Lowell A. Larson

*Attorney, Agent, or Firm*—Burgess, Dinklage & Sprung

[57] ABSTRACT

An arrangement for intermittent feeding of cable coils cut by means of a cutting arrangement, with the aid of ring laying apparatus onto a rotary conveyor wherein there are several separately driven conveyor bands each of which is fed at a different period of time with severed cable coils by a transfer unit, the transfer unit being disposed between a discharge conveyor and the separately positioned conveyor bands, the discharge conveyor in turn being constantly fed with cable coil from a ring laying unit which ring laying unit is variable and in the ring laying direction and is movable toward and away from the transfer unit during operation.

7 Claims, 4 Drawing Figures

X
Y
"X"
"Y"

ARRANGEMENT FOR INTERMITTENT FEEDING OF CABLE COILS ARRESTING ON A DISTRIBUTION CONVEYOR

The invention relates to an arrangement for intermittent feeding of cable coils with divider facilities by means of a separator arrangement.

In the manufacture of insulated conductors, according to the present state of the art a continuous strand assembly of insulated individual cores is formed, subsequently receiving an internal and external jacketing consisting for instance of a rubber-and polyvinyl chloride mixture. Furthermore, according to the present state of the art, the jacketed conductor is wound onto spools or into rosette-forms on completion of the latter operation, then placed in drums by means of suitable equipment. The conductor lengths are generally checked electrically on the spools or in drums before making up into commercial coils, so that access is required to both ends of the conductor assembly.

Rosette-forms makeup and storage in drums has the disadvantage that the insulation jacketing may be compressed at intersection points of the very recently jacketed conductor.

In order to avoid these difficulties, German Pat. No. 2,159,793 proposes that conductors be coiled into a container, thus avoiding intersection points on the one hand, as well as improving the packing factor. At this stage of the state of the art the following problems still remain;

1. Even after leaving the relevant cooling tracks, it is known that a longer period is required to dissipate extrusion heat still remaining within the conductor. In the case of larger size spools or containers, there is the risk of conductor movement within its insulating sheath as a result, particularly at intersection points, as a result of the winding stress or of the coil weight.

2. The relatively high weights of coils or drums require corresponding transportation means, such as trains, floor lifting equipment or runner tracks.

3. Particularly during the introduction into drums there is no absolute certainty that individual coils will retain a controlled position, thus leading to looping and similar defects more particularly when re-winding at high speeds.

4. Defects detected during electrical testing, i.e. core breakages or puncturing during high tension tests, must be cut out before makeup. The search for such defects results in costly spool or drum re-winding operations.

In the wire manufacturing trade, the state of the art relating to a different requirements, involves the placing of wire coils for heat treatment upon a conveyor belt (Stahlund Eisen 92, 1972, pages 1232 – 1234). Basically, in this state of the art, the wire is placed in racked coils on a suitable conveyor, i.e. chain conveyor, steel mesh conveyor, roller conveyor . . . , and the wire is then transported in that form into the various heat treatment areas.

The concentric arrangement of several given feed tracks receiving cable is known from German Pat. No. 1,189,826. Furthermore British Pat. No. 863,817 refers to a trolley picking up wire coils located on a conveyor band. As soon as the trolley is unable to pickup wire owing to a break-down of the connected equipment, the trolley moves synchronously with the conveyor. After a stoppage or break-down the trolley can only return to the starting position, providing that either the wire pickup speed is increased or the wire feed speed is reduced. Such changes in wire speeds are not normally possible when several machines are grouped in the usual manner.

Furthermore, in British Pat. No. 863,817 the coils on the conveyor are reversed before pickup by the conveyors on either side, so that each subsequent spiral to be picked up is covered. This type of reversing arrangement is costly and breakdown-prone.

The purpose of the invention is to produce an arrangement which will feed the cable spirals, without requiring any speed changes in the wire pickup or feed. Furthermore, the invention was intended to facilitate easy removal of the cable coils.

These objects have been achieved according to the invention, in that several independently driven feed conveyors are provided, their respective ends allowing connection to the supporting track and a subsequent conveyor band by way of one or several transfer points, the ring laying unit being changable in the direction of the supporting track.

In this manner it is possible to feed and pickup cable at the same speed from the arrangement according to the invention. By separating the cable coils into ring formations each individual ring formation can be advanced towards the cable pickup in anticipation with the previously deposited spiral, so that the first spiral can be picked up in the first place, and the next immediate spiral cannot be covered by the neighbouring spiral.

High manufacturing speeds can be achieved, without unfavourable pressure points resulting from conductor spirals bearing on each other. An electrical test can be rapidly completed and defects within the conductor assembly are easily detected.

Within the framework of optimum operation of the overall installation it is particularly important that the displacement speed of the ring laying unit be matched to suit the ring laying unit conveyor speed as well as the conveyor speed of the first conveyor. The relevant displacement facility ensures that on continuous transport of conductors from the extrusion line, the first conveyor can be stopped, in order to separate conductors and simultaneously, the points transfer conveyor band can be moved on to a vacant feed conveyor. During these operations the ring laying unit moves inversely to the normal transport direction over the first conveyor band, then moves back once more at a matching speed towards the starting position as the first conveyor band and points transfer band start up once more. The particular advantage of the combination as described lies in the fact that inspite of the intermittent operation (cable parting and points transfers), the continuous extrusion operation does not have to be interrupted.

As an alternative to the preferred mobile ring laying unit, there is the possibility of inserting a storage unit (loop-pit, feed roll or the like) between the extrusion unit and the ring laying unit. However, it should be noted that in this particular design the still imperfectly cooled conductor is subject to greater mechanical stress.

The transfer points are preferably designed as a tilting or pivoting transporter unit. In a particularly preferred design, the feed conveyors are stacked one above the other.

The object of the invention offers the advantage, that the insulated conductor coming from the extruder is able to cool without prejudical mechanical stressing, so that no further mechanical damage can be provoked during the cooling phase. A further advantage lies in the simplification of the transportation means.

The inspection track is preferably arranged over at least two levels, so that the in-feed or discharge operation may be effected at one level parallel with the checking at another level. For safety purposes the inspection track must be secured by protective guards locking on the outside, during the course of the high tension test. Similarly to the arrangement described initially, further points transfer conveyors are provided at the end of the respective levels. The inspection track as described has the advantage that defects in the conductor assembly can be located and marked on the conductors at a distance from the connection terminals for the test. Wound coils from the defective areas can be sorted out without considerable expenditure for submitting to individual testing. In the event of a complete failure in a tested conductor assembly, the assembly is not forwarded for making up, and is transferred directly to a reject container located beneath the inspection track.

A preferred design provides for a discharge conveyor connected to the inspection track, forming the end of the installation, and allowing re-connection to the relevant inspection track by way of a points transfer conveyor. The re-discharge preferably located on the same side as the feed. This has the advantage that the layer direction of the stacked coils changes, thus allowing conductors to be drawn overhead from a coil winder which is not described any further.

The invention then is outlined below in accordance with the following example, wherein.

Figures 1, 2:
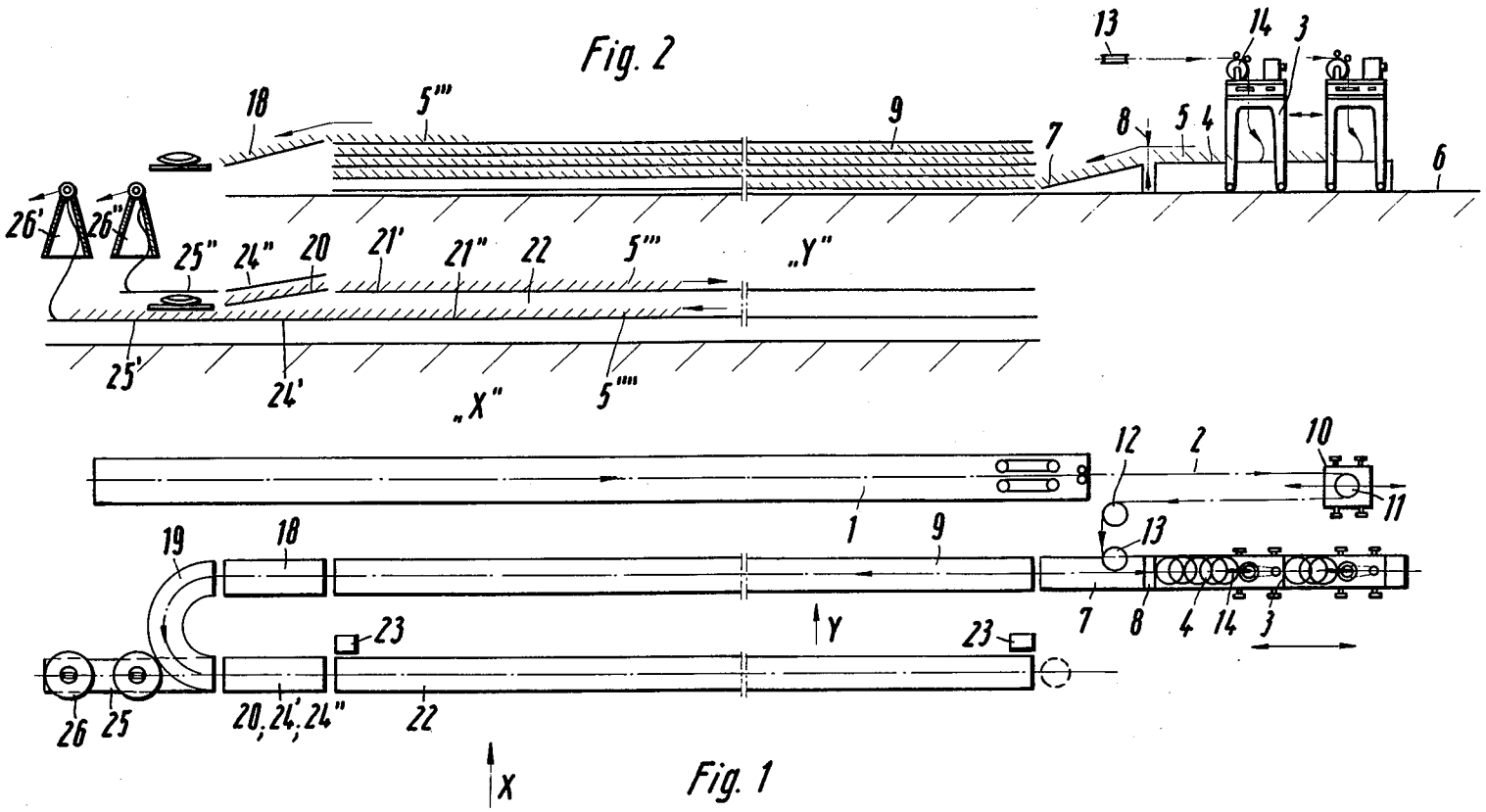
FIG. 1 is a plan view of the arrangement according to the invention.
FIG. 2 is a lateral section of the arrangement according to the invention.
Figure 3:
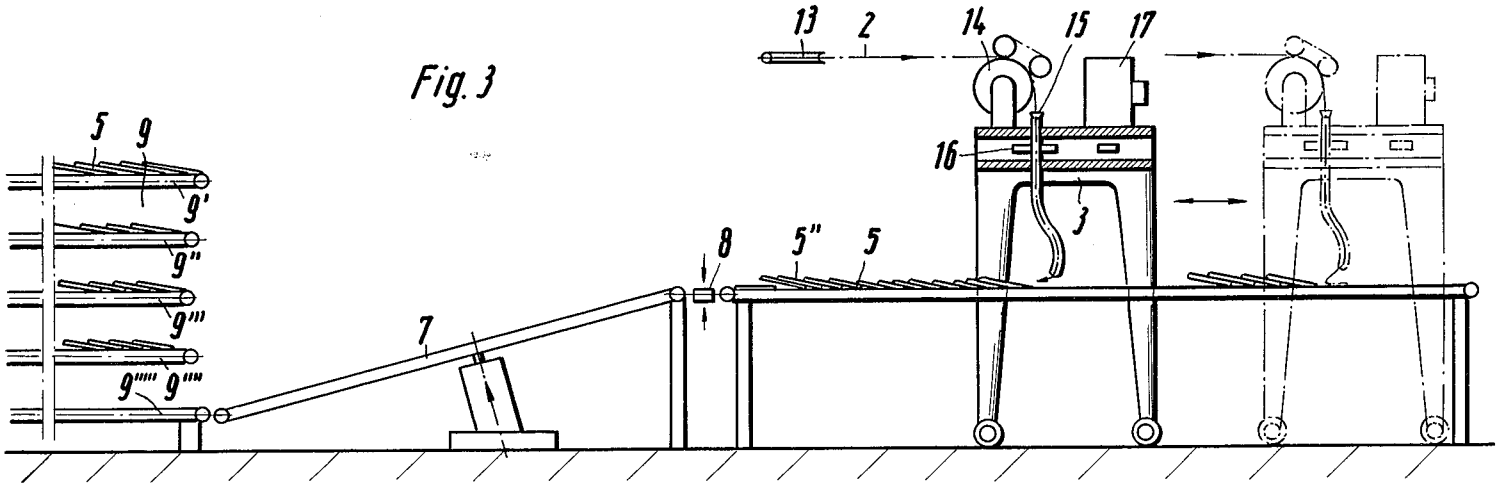
FIG. 3 is a side view of part of the arrangement according to the invention.
Figure 4:
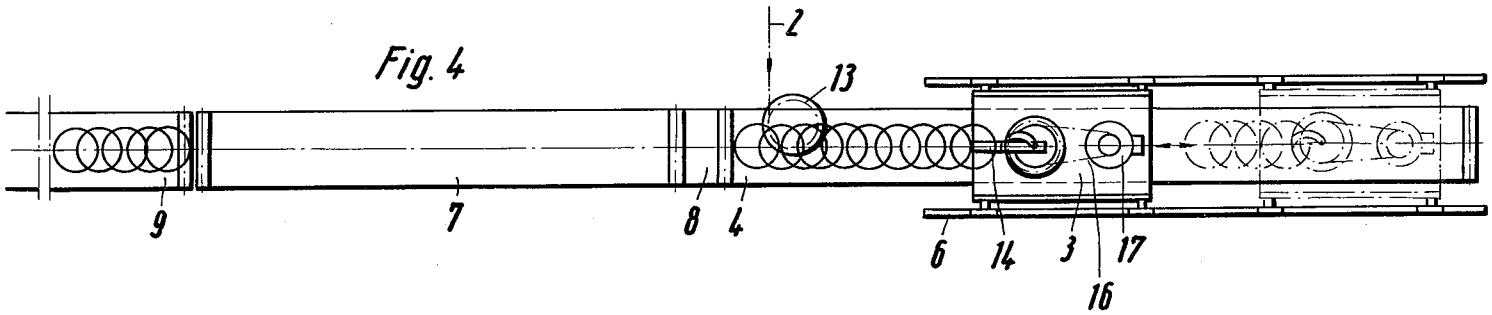
FIG. 4 is a plan view of part of the arrangement according to the invention outlined in FIG. 3.

The conductor 2 from the extrusion line 1 is placed in coils 5 on the first conveyor band 4 by means of the ring laying unit 3.

The ring laying unit 3 runs on rails 6, so that with a fixed conveyor band 4 there is always the possibility of depositing the conductor 2 in coils 5 as the ring laying unit 3 moves backwards.

A displacement of 3–5 meters has proved advantageous for the ring laying unit 3 operating at processing speeds of the order of 150 to 300 meters/minute. This distance allows sufficient time for parting the coiled conductor 2 by means of cutting facilities 8 located between a first transfer point unit 7 and a first conveyor belt 4, as well as to switch the first points 7 to a vacant conveyor belt in the group of superimposed belts 9'–9''''. As the transfer operation takes place conveyors 4,7 and an operational unit in the conveyor group 9'–9'''' are stopped, while the ring laying unit 3 moves towards the right in the manner illustrated. The speed of the ring laying unit 3 is preferably matched to the conveyor speed, so that as previously a total of five coil spirals are laid. In order to avoid speed changes in the conductor 2 - feed as a result of the displacement of the ring laying unit 3, a compensating roll 11 is located on a trolley 10 between the extruder line 1 and the ring laying unit 3. As soon as the ring laying unit 3 moves at conveyor speed from its resting position, the trolley 10 with the roll 11 moves at half conveyor speed in the opposing direction to the ring laying unit, thus ensuring compensation of the speed of the conductor assembly 2. The conductor is fed over stationary rolls 12, 13 the ring laying unit 3 and the trolley 10 are driven by a suitably graduated gearbox drive not shown here.

The ring laying unit 3 is fitted with a feed system 14 driven by a motorised slip-drive not shown here to convey the conductor 2. The ring laying arm 15 is driven by a gearbox unit 16 with infinitly variable speed motor 17. The constant speed conductor feed is consequently placed upon the conveyor belt in coils 5 of uniform diameter and at regular coil intervals. Modification of the speed of the conveyor and of the arm - r.p.m. 15 allows variation in coil density (coil interval) of the stacked coils 5 and in the coil diameter.

After completing the parting of the ring formation with the cutting arrangement 8, conveyor 7 and the relevant conveyor level 9'–9'''' proceed first of all and take the end of the feed storage levels 9. Both conveyors are then stopped and the conveyor transfer points 7 are switched to an empty position in the storage unit 9. Simultaneous start up of conveyors 4, 7 and 9 is then resumed at twice the normal speed, until the other part of the layered conductor coil 5'' reaches the beginning of the conveyor level 9''''. As the conveyors 4, 7 and 9'''' run at twice the normal speed during this interval, the ring laying unit 3 moves synchronously at normal conveyor speed back towards the left in its starting position, so that even when conveyor 4 runs at twice its normal speed, uniform coil distances are maintained. As the ring laying unit 3 reaches the end lefthand position, the whole installation proceeds at normal conveyor speed until the next level change is triggered.

Following satisfactory cooling and in accordance with the sequencing of one of the conveyor level 9'–9'''', for instance conductor lengths 5''' from conveyor 9', the conductor thus spread over several layers is forwarded from a subsequent points transfer conveyor 18 and preferably by way of a curved conveyor belt 19 to save space then once more by way of a points transfer conveyor 20 to level 21' of the inspection track 22. The conductor ends are connected in a known manner to high tension testing equipment 23. After acceptance or rejection, the conductor length 5'''' runs as shown in the example from the inspection track 21'' by way of further transfer points 24' in the manner already described towards a so-called discharge conveyor 25'. The overhead coiling is then effected by means of a suitable correcting hopper 26'.

Coils in the area of a defect are sorted and subjected to individual testing.

Transport of the conductor assembly 5''' from the feed storage conveyor 9 into the inspection track 22 is effected at approximately three times the normal conveyor speed, in order to allow sufficient time for the inspection procedure. The discharge speed towards the makeup section is arranged to match that rate.

Within the framework of a further design, the cutting facility 8 is arranged in such a manner that the free ends are laid on the conveyor belt in a suitably oriented manner, to allow eventual inspection to be carried out automatically. The section ends can be secured by means of an adaptor, the adaptor serving as a fixed point for photo-electric control for instance.

The particular advantages of the arrangement according to the invention lie in the fact that, the conductors are mechanically stressed in a uniform manner and are able to cool at a uniform ambient temperature. The finished product is fed, without the disadvantages attending the winding and unwinding of spools or drums. A further advantage of the arrangement according to the invention lies in the fact that inspection can be carried out in a simple manner and defects can be rapidly detected.

I claim:

1. An apparatus for intermittent feeding of cable coils cut by means of a cutting arrangement comprising a ring laying unit disposed in feeding relationship to a first discharge conveyor, said ring laying unit being movable with respect to said first discharge conveyor in the ring laying direction during operation, said first discharge conveyor disposed in facing relationship to a cutting unit and terminating in a transport unit, said transport unit selectively in feeding relationship to one of several separately driven conveyor bands.

2. An apparatus according to claim 1 wherein downstream of said selectively driven conveyor bands there is a curved conveyor band fed by a second discharge conveyor, said curved conveyor band feeding an inspection track.

3. Apparatus according to claim 1, the transport unit is a pivoting - or tilting transport unit.

4. An apparatus according to claim 3 further comprising means for actuating said ring laying unit away from said transport unit to dispose cable coils on said discharge conveyor when said discharge conveyor is immobile and said cutting unit is cutting and said transport unit is pivoting or tilting.

5. An apparatus according to claim 4 further comprising means for moving said discharge conveyor, said transport unit and said conveyor bands at a double rate following said cutting and pivoting or tilting and means for removing synchronously at normal rate, said ring laying unit back into the direction of the transport unit.

6. Apparatus according to claim 1, wherein the separately driven conveyor bands are superimposed above each other.

7. An apparatus according to claim 1 further comprising means for actuating said ring laying unit to dispose cable coils on said discharge conveyor when said discharge conveyor is immobile.

* * * * *